US005823926A

United States Patent [19]

Hartz

[11] Patent Number: 5,823,926

[45] **Date of Patent: *Oct. 20, 1998**

[54] CASTER ROLL CORE AND SHELL ASSEMBLY AND METHOD OF MANUFACTURING THE SAME

[75] Inventor: Warren C. Hartz, McKenzie, Tenn.

[73] Assignee: Norandal USA, Inc., Brentwood, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 672,866

[22] Filed: Jun. 28, 1996

Related U.S. Application Data

[62] Division of Ser. No. 392,427, Feb. 22, 1995, Pat. No. 5,598,633.

[51] Int. Cl.[6] ..... B23P 15/00

[52] U.S. Cl. ..... 492/1; 492/3; 492/46; 492/54; 29/895.32

[58] Field of Search ..... 29/895.2, 895.42, 29/895.32; 492/46, 54, 33, 35, 1, 3; 164/442, 444, 448; 165/89, 90

[56] References Cited

U.S. PATENT DOCUMENTS

| | | | |
|---|---|---|---|
| 4,071,081 | 1/1978 | Chielens et al. | 165/90 |
| 4,773,468 | 9/1988 | Lauener | 492/46 |
| 5,191,925 | 3/1993 | Sosin . | |
| 5,209,283 | 5/1993 | Miltzow et al. | 164/448 |
| 5,265,332 | 11/1993 | Hartz | 29/895.212 |
| 5,292,298 | 3/1994 | Scannell | 492/46 |

FOREIGN PATENT DOCUMENTS

| | | |
|---|---|---|
| 1814112 | 6/1970 | Germany . |
| 57-052557 | 3/1982 | Japan . |
| 62-275511 | 11/1987 | Japan . |
| 776482 | 6/1957 | United Kingdom . |

*Primary Examiner*—I. Cuda
*Attorney, Agent, or Firm*—Evenson, McKeown, Edwards & Lenahan, P.L.L.C.

[57] ABSTRACT

An improved caster roll core and shell assembly includes two overlays of stainless steel of different hardness which are deposited on the surface of the roll core, thus prolonging the life of the roll. The method for manufacturing the roll is also described.

26 Claims, 2 Drawing Sheets

CASTER ROLL CORE AND SHELL ASSEMBLY AND METHOD OF MANUFACTURING THE SAME

This is a divisional application of Ser. No. 08/392,427 filed on Feb. 22, 1995, now U.S. Pat. No. 5,598,633.

FIELD OF INVENTION

The present invention is concerned with an improved caster roll core and shell assembly wherein a chromium layer is plated onto the inside surface of the shell and two overlays of stainless steel of different hardness are deposited on the surface of the roll core, thus significantly prolonging the life of the roll.

BACKGROUND OF THE INVENTION

In the manufacture of aluminum foils or sheets, conventional twin roll continuous sheet casting machines comprise a pair of parallel, water-cooled, counter-rotating rolls. After being in use for a given period, the surface of the roll must be reground because of heat cracks resulting from thermal fatigue and out-of-roundness due to galling between caster core and shell. Accordingly, the shells surrounding the cores must be removed periodically, and the cores repaired and reground before rebuilding of the roll assembly.

The major cause of damage to caster roll assemblies is galling between the core and the shell, which occurs when the shell slips relative to the core under load. Cold welding of the core and shell during relative motion causes metal to be torn from the core and displaced in the interface between the two, resulting in distortion of the rolls and roll gap, creating bad shape in the continuously cast sheet.

Using such conventional roll assemblies, it is possible to cast from about 10 to 12 millions pounds of aluminum sheet before cutting of the shells and repairing and regrinding the cores. However, after regrinding two or three times, the hardened layer on the core surface is lost and the cores are destroyed by deformation. To overcome this problem, it became general practice to coat cores with a stainless steel overlay. This modification extended the service life between regrinding by about 50% and avoided destruction of cores by weld rebuilding to original dimensions and regrinding. However, the stainless steel weld overlay is still subject to cold welding and galling between the shell and the core.

Another approach to extend the service life of the core is to coat the inner surface of the shell with hard chromium, as proposed in U.S. Pat. No. 5,265,332, which is hereby incorporated by reference. Again, however, usual problems with the stainless steel overlay are present.

There is therefore a great need to develop a core having an extended service life between shell removal. Preferably, the core would be prepared by simple techniques at a reasonable cost.

SUMMARY OF THE INVENTION

In accordance with the present invention, there is now provided an improved caster roll core and shell assembly wherein the surface of the core is coated with two overlays of stainless steel, each having a distinct hardness. In the preferred embodiment of the invention, the overlay of stainless laying on the surface of the core is softer than the external overlay of stainless steel.

The present invention also comprises the method for manufacturing the improved core.

IN THE DRAWINGS

FIG. 1 is a perspective view of the core of a roll according to the present invention.

DETAILED DESCRIPTION OF THE INVENTION

The present application discloses a roll and shell assembly for making metal sheets, preferably aluminum, wherein the core of the roll comprises a dual layer stainless steel overlay which shows significantly improved properties over the rolls currently known. When used in combination with shells having the inner surface coated with chromium, the service life between shell removal and rebuilding of the rolls is extended by as much as 400%. Furthermore, the cores are found to be relatively undamaged.

Figure 1A:
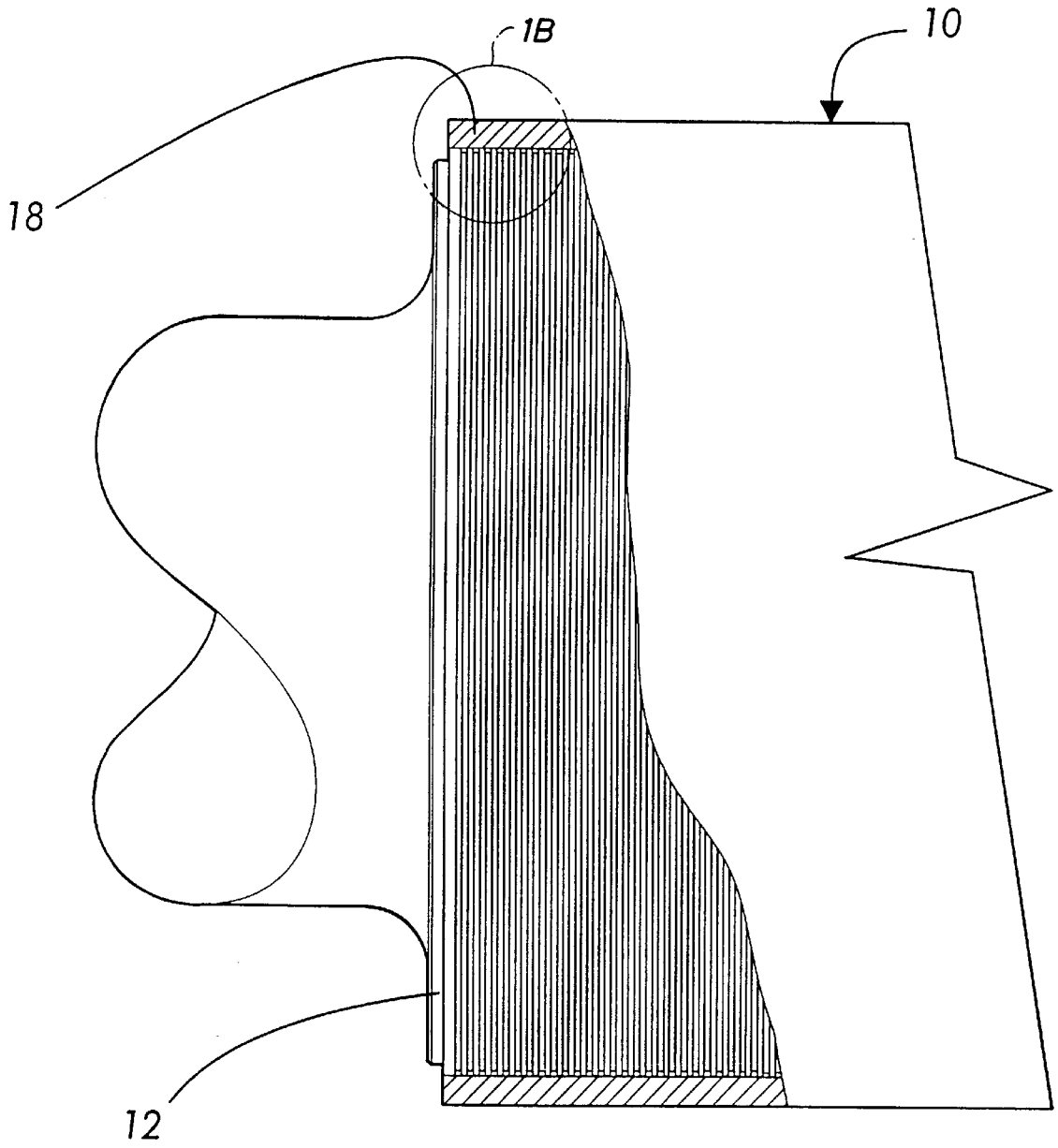
Figure 1B:
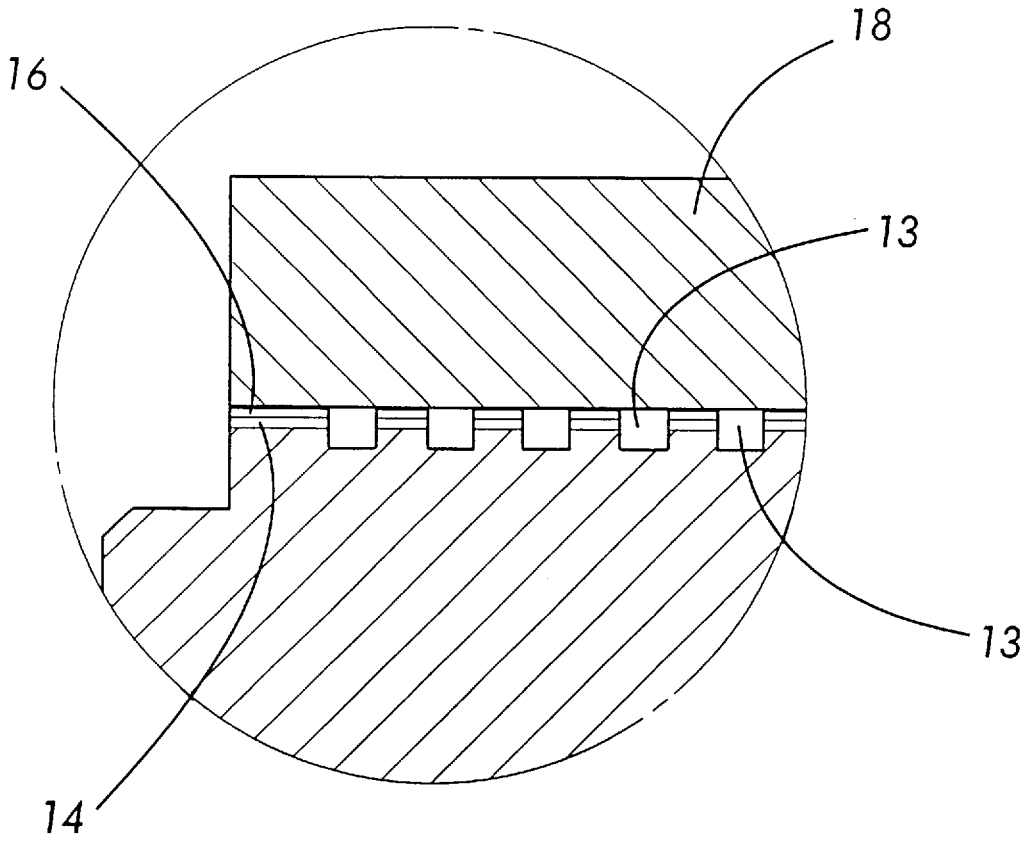

Referring to FIG. 1 which illustrates a preferred embodiment of the present invention, there is found a roll 10 comprising a core 12 having a plurality of water channels 13 for cooling, the core 12 being coated with an overlay of stainless steel 14. The thickness of this one pass overlay is preferably at least ⅛, and preferably has a hardness of from 20 to 25 on the Rockwell "C" scale. An example of a suitable stainless steel 14 is LINCORE 30, manufactured and sold by Lincoln Electric, Cleveland, Ohio. It should be noted that overlay 14 may be formed by welding several layers of ⅛ each until the desired thickness is reached.

Onto overlay 14 is laid another overlay of stainless steel 16 having a thickness of at least ⅛, preferably less than 1", and most preferably ⅝, and a hardness of from 50 to 56 on the Rockwell "C" scale. An example of a suitable stainless steel 16 is LINCORE 96S, manufactured and sold by Lincoln Electric, Cleveland, Ohio. Overlay 16 is preferably formed by welding several layers of about ⅛ each until the desired thickness is reached. This provides a structure having better mechanical properties and increased resistance to wear and tear. Once core 12 is coated with overlays 14 and 16, water channels 13 are cut therein. This operation can be carried out with any conventional router, and is rendered necessary to insure that shell 18 (discussed below) is properly cooled when the roll is in use.

A further advantage of overlays 14 and 16 is that they substantially eliminated the breaking of the sidewalls of the water channels in the core, which took place when the core was not provided with these overlays.

Finally, shell 18 preferably made of alloy steel having its inner surface coated with a layer of chromium having a thickness of from 0.001 to 0.01 inch in the manner described in U.S. Pat. 5,265,332, is shrink-fitted around overlay 16 in a conventional manner. It is believed that overlay 14 acts as an interface or cushion between the core and overlay 16 to prevent cracking and separation of the two when under stress.

In operation, the molten metal is passed between two rolls, cooled, and ejected as a metal sheet. The thickness of the sheet is adjusted by varying the space between the rolls. The present roll and shell assembly is particularly useful for manufacturing aluminum sheets, but sheets of other metals like copper, zinc and the like, may also be manufactured with these roll and shell assemblies.

The method for obtaining a roll 10 can be described as follows. A core 12 made of conventional material, for example steel or alloyed steel, is installed in a chamber and heated to a temperature of from 200° to 275°C. until the core is hot through the entirety of its structure (4–5 hours). Preferably, before heating the rolls, graphite plugs have been inserted in the holes of the channels in the core. Then, a first layer of stainless steel is welded onto the core, and this operation is repeated until the desired thickness of overlay 14 is reached.

Subsequently, a first layer of stainless steel having a hardness higher than that of overlay 14 is welded on overlay 14, and this operation is repeated until the desired thickness of overlay 16 is obtained. The roll is then placed in an insulated box and heated to a temperature of from 200° to 275°C. The box is closed and the temperature is maintained to 200°–275°C for another 6–8 hours. The temperature is then lowered slowly to room temperature. It should be noted that during all the above process, the roll is preferably turning at a speed of about 1 rpm. Finally, the water channels 13 are cut in overlays 14 and 16.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A roll for manufacturing metal sheets or foils comprising:

a core having a plurality of cooling channels;

a first metal overlay on the core; and a second metal overlay on the first metal overlay, the second metal overlay having a hardness higher than the hardness of the first metal overlay, whereby the first metal overlay acts as a cushion to prevent cracking and separation of the second overlay from the core.

2. A roll according to claim 1, wherein said cooling channels extend through at least a portion of a depth of said first and second metal overlays.

3. A roll according to claim 1, further comprising a shell having an inner surface engaged with an outer surface of said second metal overlay.

4. A roll according to claim 3, wherein said inner surface is electroplated with chromium.

5. A roll for manufacturing metal sheets or foils according to claim 1, wherein the first and second metal overlays are made of stainless steel.

6. A roll according to claim 3, wherein the hardness of the first overlay is from 20 to 25 on the Rockwell "C" scale, and the hardness of the second overlay is from 50 to 56 on the Rockwell "C" scale.

7. A roll and shell assembly for manufacturing aluminum sheets or foils comprising a roll according to claim 6, and a shell shrink-fitted onto the roll, the shell having its inner surface electroplated with chromium.

8. A roll according to claim 5 wherein the thickness of the first overlay of stainless steel is lower than the thickness of the second overlay of stainless steel.

9. A roll according to claim 8, wherein the thickness of the first overlay is about ⅛", and the thickness of the second overlay is at least ⅛".

10. A roll and shell assembly for manufacturing aluminum sheets or foils comprising a roll according to claim 9, and a shell shrink-fitted onto the roll, the shell having its inner surface electroplated with chromium.

11. A roll and shell assembly for manufacturing aluminum sheets or foils comprising a roll according to claim 8, and a shell shrink-fitted onto the roll, the shell having its inner surface electroplated with chromium.

12. A roll according to claim 5, wherein the first and second overlays are each made of several layers.

13. A roll and shell assembly for manufacturing aluminum sheets or foils comprising a roll according to claim 12, and a shell shrink-fitted onto the roll, the shell having its inner surface electroplated with chromium.

14. A roll and shell assembly for manufacturing aluminum sheets or foils comprising a roll according to claim 1, and a shell shrink-fitted onto the roll, the shell having its inner surface electroplated with chromium.

15. A roll for manufacturing metal sheets or foils, comprising:

a core having a plurality of cooling channels;

a first metal overlay on the core; and a second metal overlay on the first metal overlay, the second metal overlay having a hardness higher than the hardness of the first metal overlay;

a shell having an inner surface for engagement with an outer surface of the second metal overlay whereby the first metal overlay acts as a cushion to prevent cracking and separation of the second overlay from the core.

16. A roll according to claim 15, wherein said cooling channels extend through at least a portion of a depth of said first and second metal overlays.

17. A roll according to claim 15, wherein said inner surface is electroplated with chromium.

18. A roll for manufacturing metal sheets or foils, comprising:

a core;

a first metal overlay on the core;

a second metal overlay on the first metal overlay, the second metal overlay having a hardness higher than the hardness of the first metal overlay; and a plurality of cooling channels extending through at least a portion of a depth of said first and second metal overlays.

19. A roll according to claim 18, wherein said cooling channels extend through the depth of said first and second metal overlays into a depth of said core.

20. A roll according to claim 18, further comprising a shell having an inner surface engaged with an outer surface of said second metal overlay.

21. A roll according to claim 20, wherein said inner surface is electroplated with chromium.

22. A roll for manufacturing metal sheets or foils, comprising:

a core defining a plurality of cooling channels;

a shell shrink-fitted around said core, said shell having an outermost surface for engagement with the metal sheets or foils;

a first metal layer disposed between the core and the shell; and a second metal layer disposed between the first metal layer and the shell, said second metal layer having a hardness higher than a hardness of the first metal layer.

23. A roll according to claim 22, wherein said shell includes a layer of chromium coated on an inner surface thereof.

24. A roll according to claim 22, wherein said core, said first metal layer, said second metal layer, and said shell are disposed in successive order, directly adjacent and abutting each other.

25. A roll according to claim 22, wherein said cooling channels extend into a depth of at least one of said first and second metal layers.

26. A roll according to claim 25, wherein said cooling channels extend through an entirety of the depth of both of said first and second metal layers.

* * * * *